US008322910B2

(12) United States Patent
Gansmuller et al.

(10) Patent No.: US 8,322,910 B2
(45) Date of Patent: Dec. 4, 2012

(54) APPARATUS AND METHOD FOR MIXING BY PRODUCING SHEAR AND/OR CAVITATION, AND COMPONENTS FOR APPARATUS

(75) Inventors: Erich William Gansmuller, Loveland, OH (US); Ke-ming Quan, West Chester, OH (US); Yunpeng Yang, Mason, OH (US); Francesc Corominas, Grimbergen (BE)

(73) Assignee: The Procter & Gamble Company, Cincinnati, OH (US)

( * ) Notice: Subject to any disclaimer, the term of this patent is extended or adjusted under 35 U.S.C. 154(b) by 678 days.

(21) Appl. No.: 12/504,859

(22) Filed: Jul. 17, 2009

(65) Prior Publication Data

US 2010/0020631 A1 Jan. 28, 2010

Related U.S. Application Data

(60) Provisional application No. 61/083,583, filed on Jul. 25, 2008.

(51) Int. Cl.
*B01F 5/04* (2006.01)
*B01F 5/08* (2006.01)

(52) U.S. Cl. ..... 366/173.1; 366/175.2; 366/176.2

(58) Field of Classification Search ..... 366/163.1, 366/163.2, 167.1, 173.1, 174.1, 337, 175.2, 366/181.5, 181.8, 182.4, 182.2, 173.2, 176.1–176.4; 137/889, 892–896

See application file for complete search history.

(56) References Cited

U.S. PATENT DOCUMENTS 3,176,964 A 4/1965 Cottell
3,278,165 A * 10/1966 Gaffney ..... 366/119
3,399,031 A 8/1968 McCarthy
3,410,529 A 11/1968 Simonetti
(Continued)

FOREIGN PATENT DOCUMENTS

EP 889244 A2 * 1/1999
(Continued)

OTHER PUBLICATIONS

International Search Report dated Nov. 4, 2009 containing 118 pages.

*Primary Examiner* — Charles E Cooley
(74) *Attorney, Agent, or Firm* — Jeffrey V Bamber; Kim W Zerby

(57) ABSTRACT

An apparatus and method for mixing by producing shear and/or cavitation, and components for the apparatus are disclosed. In one embodiment, the apparatus includes a mixing and/or cavitation chamber with an element such as an orifice component that is located adjacent the entrance of the cavitation chamber. The apparatus may further include a blade, such as a knife-like blade, disposed inside the mixing and/or cavitation chamber opposite the orifice component. In one version of such an embodiment, the apparatus is configured to be cleaned in place. The apparatus may, be provided with at least one drain in liquid communication with the mixing chamber. If the apparatus comprises a blade, the apparatus may further include a blade holder that is movable so that the distance between the tip of the blade and the discharge of the orifice can be varied. In this or other embodiments, the apparatus is configured to be scalable. In this, or other embodiments, the apparatus is provided with an injector that is movable so that the distance between the discharge end of the injector and the orifice can be adjusted. A process for mixing by producing shear and/or cavitation in a fluid is also contemplated herein.

14 Claims, 10 Drawing Sheets

U.S. PATENT DOCUMENTS

| | | | | |
|---|---|---|---|---|
| 3,926,413 | A | 12/1975 | D'Urso | |
| 4,127,332 | A | 11/1978 | Thiruvengadam et al. | |
| 4,675,194 | A | 6/1987 | Gaffney | |
| 5,026,167 | A | 6/1991 | Berliner, III | |
| 5,387,376 | A | 2/1995 | Gasser | |
| 5,492,654 | A | 2/1996 | Kozjuk | |
| 5,810,052 | A | 9/1998 | Kozyuk | |
| 5,837,272 | A | 11/1998 | Fierro, Jr. | |
| 5,931,771 | A | 8/1999 | Kozyuk | |
| 5,937,906 | A | 8/1999 | Kozyuk | |
| 5,969,207 | A | 10/1999 | Kozyuk | |
| 5,971,601 | A | 10/1999 | Kozyuk | |
| 6,293,294 | B1 * | 9/2001 | Loeb et al. | 137/1 |
| 6,331,314 | B1 | 12/2001 | Klinksiek | |
| 6,365,555 | B1 | 4/2002 | Moser | |
| 6,502,979 | B1 | 1/2003 | Kozyuk | |
| 6,802,639 | B2 | 10/2004 | Kozyuk | |
| 6,857,774 | B2 | 2/2005 | Kozyuk | |
| 7,041,144 | B2 | 5/2006 | Kozyuk | |
| 7,178,975 | B2 | 2/2007 | Kozyuk | |
| 7,207,712 | B2 | 4/2007 | Kozyuk | |
| 7,247,244 | B2 | 7/2007 | Kozyuk | |
| 7,314,516 | B2 | 1/2008 | Kozyuk | |
| 7,338,551 | B2 | 3/2008 | Kozyuk | |
| 7,416,326 | B2 * | 8/2008 | Sakata et al. | 366/163.2 |
| 7,762,715 | B2 * | 7/2010 | Gordon et al. | 366/176.1 |
| 8,033,714 | B2 * | 10/2011 | Nishioka et al. | 366/163.2 |
| 8,042,989 | B2 * | 10/2011 | Gordon et al. | 366/176.1 |
| 8,182,132 | B2 * | 5/2012 | Nagai et al. | 366/173.1 |
| 2006/0109738 | A1 | 5/2006 | Buchholz | |
| 2009/0003123 | A1 * | 1/2009 | Morrison et al. | 366/76.1 |
| 2010/0020631 | A1 * | 1/2010 | Gansmuller et al. | 366/137.1 |
| 2010/0020632 | A1 * | 1/2010 | Corominas | 366/173.1 |
| 2011/0172137 | A1 * | 7/2011 | Corominas et al. | 510/527 |
| 2011/0305102 | A1 * | 12/2011 | Berger et al. | 366/154.1 |

FOREIGN PATENT DOCUMENTS

| | | | |
|---|---|---|---|
| EP | 1222957 | A | 7/2002 |
| GB | 1556158 | A | 11/1979 |
| GB | 2072029 | A | 9/1981 |
| JP | 61000434 | A | 1/1986 |
| WO | WO-99/44413 | A | 9/1999 |
| WO | WO-09/001323 | A2 | 12/2008 |
| WO | 2011/052416 | A1 * | 5/2011 |

* cited by examiner

APPARATUS AND METHOD FOR MIXING BY PRODUCING SHEAR AND/OR CAVITATION, AND COMPONENTS FOR APPARATUS

CROSS REFERENCE TO RELATED APPLICATION

This application claims the benefit of U.S. Provisional Application Ser. No. 61/083,583, filed Jul. 25, 2008.

FIELD OF THE INVENTION

The present invention is directed to an apparatus and method for mixing by producing shear and/or cavitation, and components for the apparatus.

BACKGROUND OF THE INVENTION

Cavitation refers to the process of forming vapor bubbles in a liquid. This can be done in a number of manners, such as through the use of a swiftly moving solid body (as an impeller), hydrodynamically, or by high-frequency sound waves.

Apparatuses and methods for producing cavitation are described in U.S. Pat. Nos. 3,399,031; 4,675,194; 5,026,167; 5,492,654; 5,810,052; 5,837,272; 5,931,771; 5,937,906; 5,969,207; 5,971,601; 6,365,555 B1; 6,502,979 B1; 6,802,639 B2; 6,857,774 B2; 7,041,144 B2; 7,178,975 B2; 7,207,712 B2; 7,247,244 B2; 7,314,516 B2; and 7,338,551 B2. One particular apparatus for producing hydrodynamic cavitation is known as a liquid whistle. Liquid whistles are described in Chapter 12 "Techniques of Emulsification" of a book entitled *Emulsions—Theory and Practice,* 3$^{rd}$ Ed., Paul Becher, American Chemical Society and Oxford University Press, NY, N.Y., 2001. An example of a liquid whistle is a SONOLATOR® high pressure homogenizer, which is manufactured by Sonic Corp. of Stratford, Conn., U.S.A. The liquid whistle directs liquid under pressure through an orifice into a chamber having a knife-like blade therein. The liquid is directed at the blade, and the action of the liquid on the blade causes the blade to vibrate at audible or ultrasonic frequencies. Hydrodynamic cavitation is produced in the liquid in the chamber downstream of the orifice.

Liquid whistles have been in use for many years, and have been used as in-line systems, single or multi-feed, to instantly create fine, uniform and stable emulsions, dispersions, and blends in the chemical, personal care, pharmaceutical, and food and beverage industries.

It has been found, however, that improvements to such devices may be desirable. In particular, some of such devices need to be more easily cleanable, especially when they are used for processing products with microbial sensitivity (subject to growth of microbes) such as food products, cosmetics, and pharmaceuticals. For example, although the SONOLATOR® high pressure homogenizer is available in "clean-in-place" models, such a feature is only available on very simple models which have no mechanism for adjusting the spacing of the blade relative to the orifice.

In addition, at least some of these devices are not scalable for some transformations. For example, in some cases where a pilot-size unit is used prior to "scaling up" to a production-size unit for commercial production, the physical properties (such as stability, viscosity, appearance, and micro-structure) of the finished product produced by the production-sized unit may be quite different from those of the product produced by the pilot-size unit, even under the same operating conditions. As used herein, the term "operating conditions" refers to conditions such as: pressure drop, back pressure, temperature of liquid components fed into the apparatus, and the distance between the blade and the orifice. The search for improved apparatuses and methods for mixing by producing shear and/or cavitation, and components for such apparatuses has, therefore, continued.

SUMMARY OF THE INVENTION

The present invention is directed to an apparatus and method for mixing by producing shear and/or cavitation, and components for the apparatus. There are numerous non-limiting embodiments of the present invention.

In one non-limiting embodiment, an apparatus for mixing by producing shear and/or cavitation is disclosed. The apparatus comprises: a mixing and/or cavitation chamber having an entrance, at least one inlet, and at least one outlet; and at least one element with at least one orifice therein located adjacent the entrance of the mixing and/or cavitation chamber. In one version of this embodiment, the apparatus is configured to be cleaned in place. The apparatus may, for example, be provided with at least one drain in liquid communication with the mixing and/or cavitation chamber. The apparatus may further comprise at least one blade in the mixing and/or cavitation chamber disposed opposite the element with the orifice therein. If the apparatus comprises at least one blade, the apparatus may further comprise a blade holder that is movable so that the distance between the tip of the blade(s) and the discharge of the orifice can be varied. Improvements to the mixing and/or cavitation chamber, blade, blade holder, and orifice component are also described herein.

In these or other embodiments, the apparatus may be configured to be scalable. In one version of such an embodiment, the apparatus is provided with an injector that is movable so that the distance between the discharge end of the injector and the at least one orifice can be adjusted. In this, or other embodiments, the upstream mixing chamber has a diameter measured at the centerline of the inlet, and the dimension measured from the centerline of the inlet to the point where the upstream mixing chamber first narrows at a location downstream of the inlet is greater than or equal to about 1.1 times the diameter of the upstream mixing chamber measured at the centerline of the inlet.

A process for mixing by producing shear and/or cavitation in a fluid is also described herein.

BRIEF DESCRIPTION OF THE DRAWINGS

The following detailed description will be more fully understood in view of the drawings in which.

Figure 1:
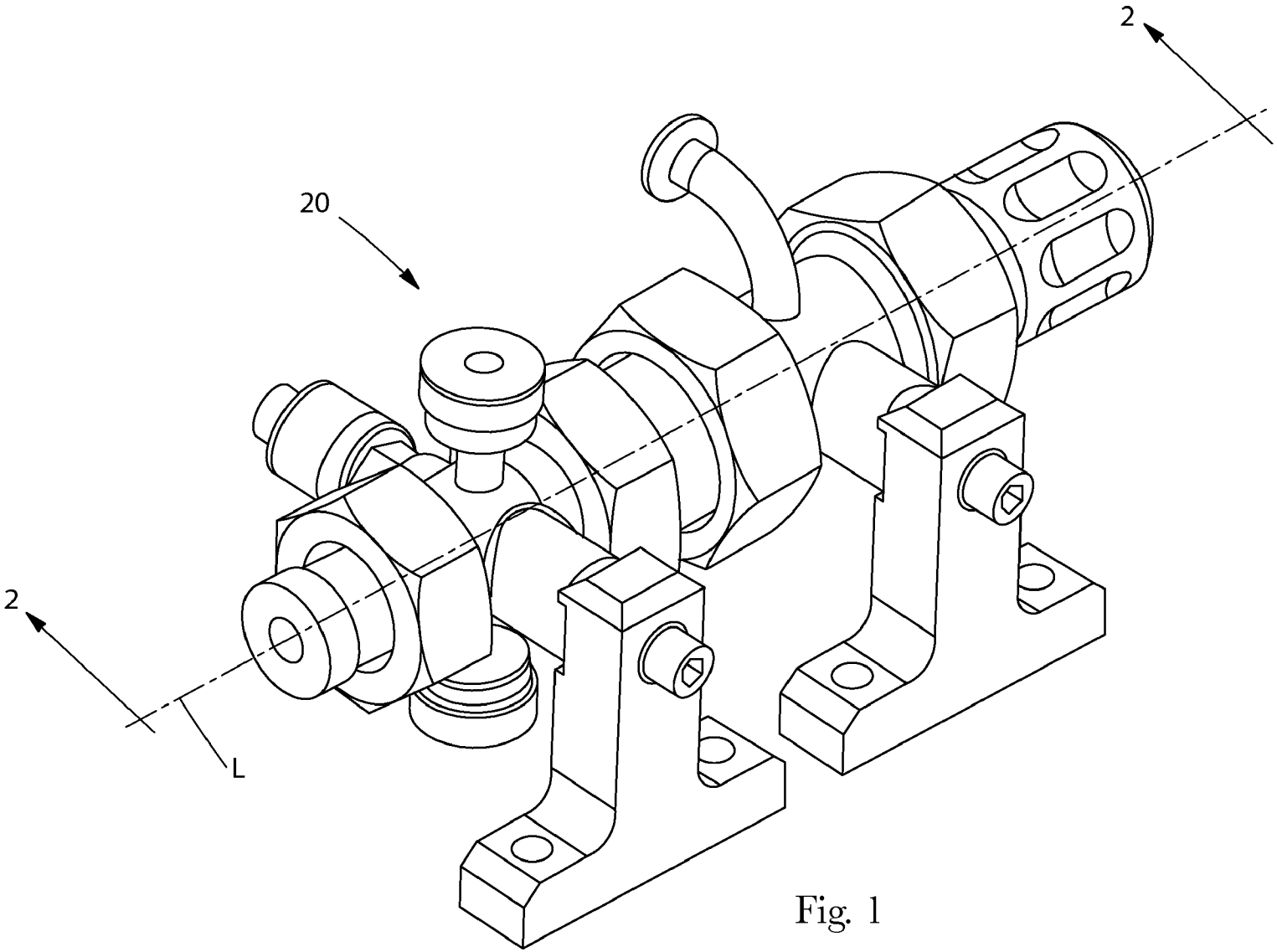
FIG. 1 is a perspective view of one embodiment of an apparatus for mixing by producing shear and/or cavitation.

The embodiments shown in the drawings are illustrative in nature and are not intended to be limiting of the invention defined by the claims. Moreover, individual features of the drawings and the invention will be more fully apparent and understood in view of the detailed description.

DETAILED DESCRIPTION

The present invention is directed to an apparatus and method for mixing by producing shear and/or cavitation. It should be understood that, in certain embodiments, the ability of the apparatus and method to induce shear may not only be useful for mixing, but may also be useful for dispersion of solid particles in liquids and in breaking up solid particles. In certain embodiments, the ability of the apparatus and method to induce shear and/or produce cavitation may also be useful for droplet and/or vesicle formation.

Figure 2:
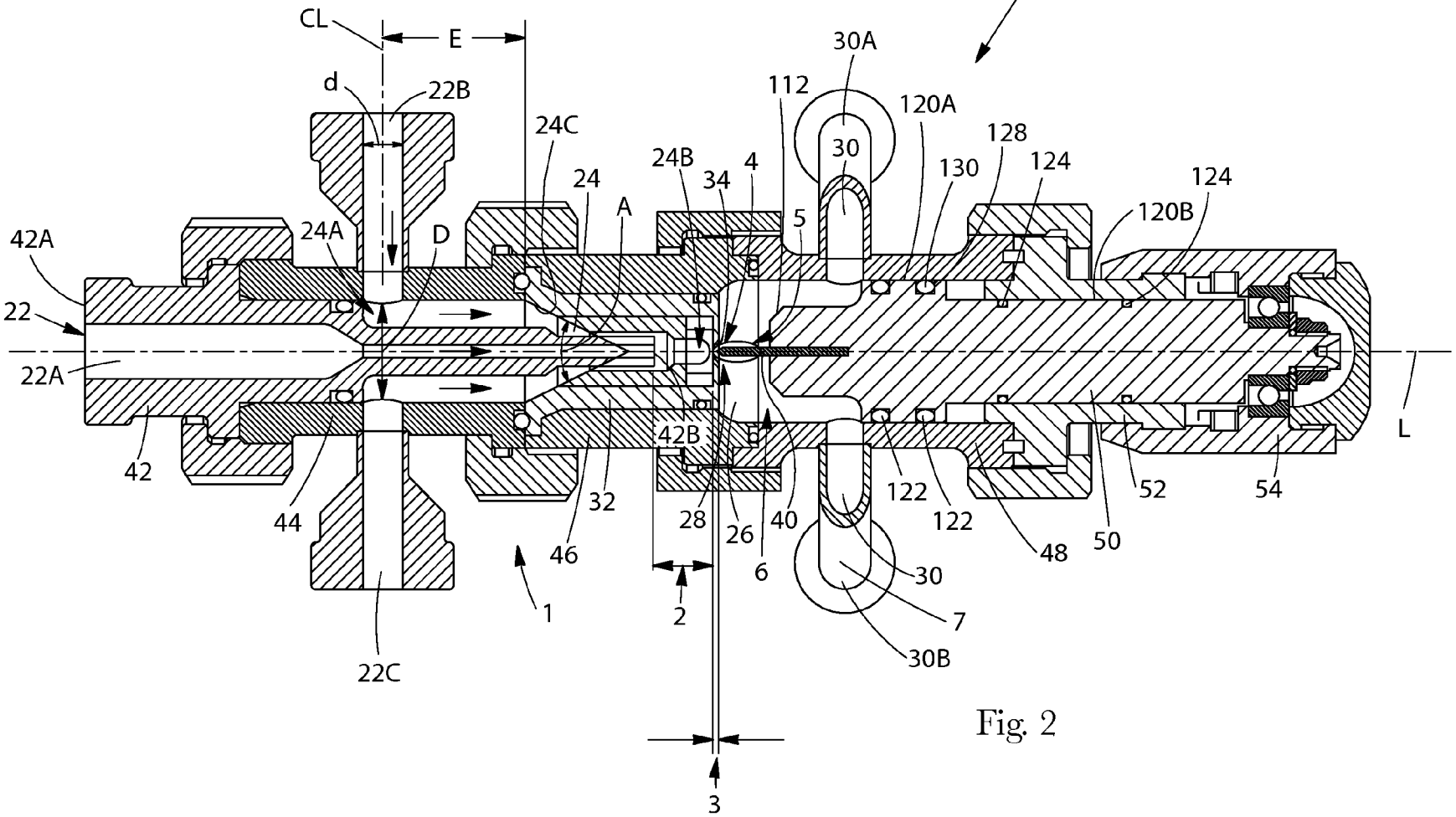
FIG. 2 is a partially fragmented cross-sectional view of the apparatus shown in FIG. 1 taken along line 2-2 of FIG. 1.

FIGS. 1 and 2 show one non-limiting embodiment of an apparatus 20 for mixing by producing shear and/or cavitation. The apparatus 20 may have a longitudinal axis, L. As shown in FIG. 2, the apparatus 20 comprises: at least one inlet, designated generally by reference number 22; a pre-mix chamber (or "upstream mixing chamber") 24; a mixing chamber (or "downstream mixing chamber") 26 which comprises an entrance 28, and at least one outlet, designated generally by reference number 30; and at least one element or structure such as an orifice component 32 with an orifice 34 therein. The element 32 is located adjacent (near) the entrance 28 of the downstream mixing chamber 26. The apparatus 20 may, but need not, further comprise at least one blade 40, such as a knife-like blade, disposed in the downstream mixing chamber 26 opposite the element 32 with an orifice therein.

The apparatus 20 can comprise a hydrodynamic cavitation apparatus. One example of such an apparatus is a liquid whistle. One commercial example of a liquid whistle is the SONOLATOR® high pressure homogenizer available from Sonic Corp. of Stratford, Conn., U.S.A. SONOLATOR® high pressure homogenizers are described in the U.S. Pat. No. 3,176,964 issued to Cottell, et al. and U.S. Pat. No. 3,926,413 issued to D'Urso. The apparatus 20 described herein contains additional features and improvements relative to certain existing devices.

The components of the present apparatus 20 can include: an injector component 42, an inlet housing 44, an orifice housing (or "orifice support component") 46, the orifice component 32, a downstream mixing chamber housing 48, a blade holder 50, an adjuster support 52 and an adjustment component 54 for adjusting the distance between the tip of blade 40 and the discharge of the orifice 34. It may also be desirable for there to be a throttling valve (which may be external to the apparatus 20) that is located downstream of the downstream mixing chamber 26 to vary the pressure in the downstream mixing chamber 26. The inlet housing 44, upstream mixing chamber housing 46, and downstream mixing chamber housing 48 can be in any suitable configurations. Suitable configurations include, but are not limited to cylindrical, configurations that have elliptical, or other suitable shaped cross-sections. The configurations of each of these components need not be the same. In one embodiment, these components comprise generally comprise cylindrical elements that have substantially cylindrical inner surfaces and generally cylindrical outer surfaces.

These components can be made of any suitable material(s), including but not limited to: stainless steel, AL6XN, Hastalloy, and titanium. It may be desirable that at least portions of the blade 40 and orifice component 32 to be made of materials with higher surface hardness or higher hardnesses. Suitable materials with higher surface hardness or higher hardnesses are described in provisional U.S. Patent Application Ser. No. 60/937,501, filed Jun. 28, 2007. The components of the apparatus 20 can be made in any suitable manner, including but not limited to by machining the same out of solid blocks of the materials described above. The components may be joined or held together in any suitable manner.

The term "joined", as used in this specification, encompasses configurations in which an element is directly secured to another element by affixing the element directly to the other element; configurations in which the element is indirectly secured to the other element by affixing the element to intermediate member(s) which in turn are affixed to the other element; configurations where one element is held by another element; and configurations in which one element is integral with another element, i.e., one element is essentially part of the other element. In certain embodiments, it may be desirable for at least some of the components described herein to be provided with threaded, clamped, or pressed connections for joining the same together. One or more of the components described herein can, for example, be clamped, held together by pins, or configured to fit within another component.

For the purposes of discussion, the apparatus 20 (especially the interior thereof) may be considered to comprise several zones. These will be designated Zone 1, Zone 2, Zone 3, Zone 4, Zone 5, Zone 6 and Zone 7. Zone 1 comprises the portion of the upstream mixing chamber 24 prior to the location where the two or more streams of liquid fed into the apparatus 20 meet. The flow of streams of liquid is indicated by arrows in FIG. 2. Zone 1 may be thought of as a channel portion that serves as a flow conditioning zone. The channel portion has an upstream end, a downstream end, and interior walls that define a liquid passageway through the channel portion. The streams of liquid can be fed into the apparatus 20 radially, tangentially, and axially. Zone 2 comprises the portion of the upstream mixing chamber 24 located before the entry to the orifice 34 after the streams of liquid are brought in contact with one another. Zone 3 comprises a zone in the orifice 34. Zone 4 comprises a zone located in the region extending from where the liquid exits the orifice 34 to the leading edge 84 (shown in FIG. 8) of the blade 40. Zone 5 comprises a zone surrounding the blade 40 (that is, the boundary layer of the blade). Zone 5 can be further subdivided into: (A) a boundary layer separation zone; and (B) a recirculation zone. Zone 6 comprises the remainder of the inside of the mixing chamber 26 downstream of the orifice outside of Zone 5. Zone 7 comprises the discharge ports, designated generally 30.

The apparatus 20 comprises at least one inlet (or "inlet conduits") 22, and typically comprises two or more inlets, such as inlets 22A, 22B, and 22C, so that more than one material can be fed into the apparatus 20. The apparatus 20 can comprise any suitable number of inlets (e.g., 1, 2, 3, 4, 5, . . . , etc.) so that any of such numbers of different materials can be fed into the apparatus 20. The apparatus 20 may also comprise at least one drain, or at least one dual purpose, bidirectional flow conduit that serves as both an inlet and drain. The inlets and any drains may be disposed in any suitable orientation relative to the remainder of the apparatus 20. The inlets and any drains may, for example, be axially, radially, or tangentially oriented relative to the remainder of the apparatus 20. They may form any suitable angle relative the longitudinal axis of the apparatus 20. The inlets and any drains may be disposed on the sides of the apparatus. If the inlets and drains are disposed on the sides of the apparatus, they can be in any suitable orientation relative to the remainder of the apparatus. It may be desirable for any drain to be located on the gravitational bottom of the apparatus 20 and to have at least an initial section that extends straight downwardly therefrom. It also may be desirable for at least one inlet to be oriented at an angle of 180 degrees relative to the drain, for ease of flushing the apparatus 20.

In the embodiment shown in FIG. 2, the apparatus 20 comprises one inlet 22A in the form of an injector component 42 that is axially oriented relative to the remainder of the apparatus. The injector component 42 comprises an inlet for a first material. The injector component 42 has an upstream end 42A and a downstream end 42B.

The first material may comprise any suitable fluid. The fluid can comprise any suitable liquid or gas. In some embodiments, it may be desirable for the fluid to comprise two or more different phases, or multiple phases. The different phases can comprise one or more liquid, gas, or solid phases. In the case of liquids, it is often desirable for the liquid to contain sufficient dissolved gas for cavitation. Suitable liquids include, but are not limited to: water, oil, solvents, liquefied gases, slurries, and melted materials that are ordinarily solids at room temperature. Melted solid materials include, but are not limited to waxes, organic materials, inorganic materials, polymers, fatty alcohols, and fatty acids. The first material may, for example, comprise an oil, or an aqueous material. The first material may be heated or unheated. In one embodiment of a process of using the apparatus 20, the first material comprises a heated oil.

The fluid(s) can also have solid particles therein. The particles can comprise any suitable material including, but not limited to: $TiO_2$, bismuth containing materials, ZnO, $CaCO_3$, $Na_2SO_4$, and $Na_2CO_3$. The particles can be of any suitable size, including macroscopic particles and nanoparticles. In some cases, at least some of these solid particles may be amorphous. In some cases, at least some of these solid particles may be crystalline. In some cases, at least some of the solid particles may be abrasive. These particles may be present in any suitable amount in the liquid. Suitable amounts may fall within any suitable range, including but not limited to between about 0.001% to about 65%, or more; alternatively between about 0.01% to about 40%; alternatively between about 0.1% to about 10%; or, alternatively between about 0.5% and about 4% by weight.

The apparatus 20 also comprises a second inlet 22B. The second inlet 22B can be used to introduce an additional stream of the first material into the apparatus, or it can be used to introduce a second material into the apparatus. If a second material is fed into the apparatus, the second material may comprise any of the general types of materials described in conjunction with the first material. The second material may also be heated or unheated. In one embodiment of a process of using the apparatus 20, the second material comprises an unheated aqueous material. The materials can be supplied to the apparatus 20 in any suitable manner including, but not limited to through the use of pumps and motors powering the same. The pumps can supply the materials to the apparatus 20 under the desired pressure.

In the embodiment shown in FIG. 2, the apparatus 20 further comprises at least one drain or dual purpose, bidirectional flow conduit 22C that can serve as both an inlet and drain. In this embodiment, the second inlet 22B, the combination inlet/drain 22C, and the injector component 42, can comprise high pressure connections so that the materials can be fed into the apparatus 20 under high pressure, such as by high pressure pumps. The inlets 22A, 22B, and 22C may, for example, comprise connections that are capable of handling liquid under pressures of between about 100-10,000 psi (about 7-700 bar) or more, or alternatively between about 200-5,000 psi (about 15-350 bar). In this embodiment, the second inlet 22B and the combination inlet/drain 22C are arranged in an opposing configuration, and are respectively located on the gravitational top and bottom of the apparatus 20. This provides better drainability of the apparatus 20 when cleaning the apparatus.

The apparatus 20 may be provided with one or more features that allow the apparatus to be more "scalable" than certain prior liquid whistles. As used herein, the term "scalable" refers to equipment that provides substantially the same processing conditions and results from using the equipment, such that a process can be scaled-up from at least one size unit to another. "Scale-up" is a methodological approach to building a manufacturing process using data obtained from a smaller scale process, with the objective of producing identical (high quality) product, in a reasonable period of time following construction completion. Scale-up can be done from lab bench-top to pilot-plant scale, from pilot-plant to "semi-works" (or small production unit) size, and from "semi-works" size to large national scale manufacturing systems. The work of the scale-up study is the analysis of the fundamental transformations that take place in a process to a level of understanding that the probability of similar operation and product between the different scales is very high. Typically, scale-up between different size units is carried out between units that differ in maximum flow rate by a factor of any number between two and fifteen, or alternatively between five and fifteen, for example, such as a factor of ten. As used herein, a "transformation" is the conversion (physical, chemical, thermodynamic, biological, or combinations thereof) of a material or materials from one form to another. Examples of transformations in chemical, mechanical, and packaging processes include emulsification, hydration, crystallization, binding, cutting, etc.

Typically, the scale of apparatuses of the types described herein can be described in terms of the amount of liquid that can be processed through the apparatuses. Such apparatuses may, for example, range in size from a pilot scale unit capable of processing 3-15 L/minute to a semi-works, or small full scale production units that are capable of processing 30-200 L/minute to large full scale production units capable of processing 300-1,500 L/min. Such flow rate ranges may be overlapping, or non-overlapping. In some embodiments, it may be desirable to provide a set of two or more apparatuses of different sizes/scales that provide substantially the same processing conditions in the time and space domains in each size of apparatus wherein the apparatuses are scalable. Such processing conditions may include, but are not limited to substantially the same: mass weighted residence time and/or residence time distribution of liquid in the upstream mixing chamber; velocity of liquid flowing into the orifice; distribution of materials through each of the different zones, in particular across the opening of the orifice; mass weighted residence time and/or residence time distribution of liquid in the downstream mixing chamber; and, local turbulent dissipation rate. Typically, such processing conditions will be compared at the respective design or "centerline" flow rates for each apparatus for the particular composition or formula being processed. That is, if a composition is made on one scale of apparatus, the composition will typically be made at a certain flow rate in order for the composition to have the desired properties. In order to make substantially the same composition on a second apparatus of a different size/scale, a greater or lesser centerline flow rate will be selected for operating the second apparatus. It is understood that the centerline flow rates may depend on the desired characteristics of the composition being processed.

By "substantially the same" processing conditions, it is meant that at least some of the aforementioned processing conditions, with the exception of the turbulent dissipation rate, are within a range of about 75%-125% of that of an apparatus of one size/scale smaller or larger. With respect to the turbulent dissipation rate, "substantially the same" processing conditions refers to turbulent dissipation rates that are within a factor of ten (that is, ten times) each other. Turbulent dissipation rate can be measured in Zones 3, 4, 5, and 6. In some embodiments, it may be specified that the turbulent dissipation rates are within a factor of five of each other. The processing conditions described in this paragraph are calculated using Computational Fluid Dynamics (CFD), and more specifically, are calculated using Fluent software available from Fluent, Inc. (subsidiary of ANSYS, Inc.) of Lebanon, N.H., U.S.A.

In one embodiment, Zone 1 may be elongated to provide a more scalable apparatus 20. The portion of the upstream mixing chamber 24 in Zone 1 at the second inlet 22B has a diameter D. It may be desirable for the ratio of the diameter D of the upstream mixing chamber 24 measured at the centerline of the inlet to the diameter d of the inlet to be greater than 2. When Zone 1 is described herein as being "elongated", this refers to the fact that the dimension E measured from the centerline, CL, of the inlet 22B to the to the point where the upstream mixing chamber 24 first narrows at a location downstream of the inlet 22 is greater than or equal to about 1.1 D. Without being bound by any particular theory, it is believed that these relationships will allow the flow of liquid coming from the inlet 22B to be slowed, and to be formed into a generally axially symmetric configuration (e.g., a generally cylindrical configuration in the embodiment shown) before it is accelerated further downstream in the apparatus 20. This will allow control to be maintained over the conditions of the liquid flowing into the orifice 34. Without wishing to be bound by any particular theory, it is believed that if the flow of liquid is more axially symmetric in apparatuses of different sizes/scales, the apparatuses will be more nearly scalable. If the characteristics of the flow of liquid, such as symmetry of flow, vary significantly between apparatuses of different sizes/scales, then it will be difficult to make such devices substantially scalable.

In some versions of such an embodiment, the injector component 42 is reconfigurable/adjustable to vary the residence time and/or residence time distribution of the liquid in Zone 1. The injector component 42 may, for example, be interchangeable/replaceable, or it may be movable (e.g., provided with a threaded mechanism for movement inwardly and/or outwardly, or it may be slidable). Providing a reconfigurable/adjustable injector component 42 may allow the residence time and/or residence time distribution of the liquid in Zone 1 to be adjusted so that they are matched between different scales of apparatuses.

The upstream mixing chamber 24 has an upstream end 24A, a downstream end 24B, and interior walls 24C. In certain embodiments, it may further be desirable for at least a portion of the upstream mixing chamber 24 to be provided with an initial axially symmetrical constriction zone 24D that is tapered in Zone 1 (prior to the location of the 42B downstream end of injector 42) so that the size (e.g., diameter) of the upstream mixing chamber 24 becomes smaller toward the downstream end 24B of the upstream mixing chamber 24 as the orifice 34 is approached. In some of the cases where a portion 24D of the upstream mixing chamber 24 is tapered, the tapered portions of the walls of the upstream mixing chamber 24 may form an included angle, A, with respect to each other of greater than or equal to about 11° and less than about 135°. The included angle A may, for example be less than or equal to about 90°. This may also assist in forming the liquid stream flowing into the orifice 34 in an axially symmetrical configuration.

Figure 4:
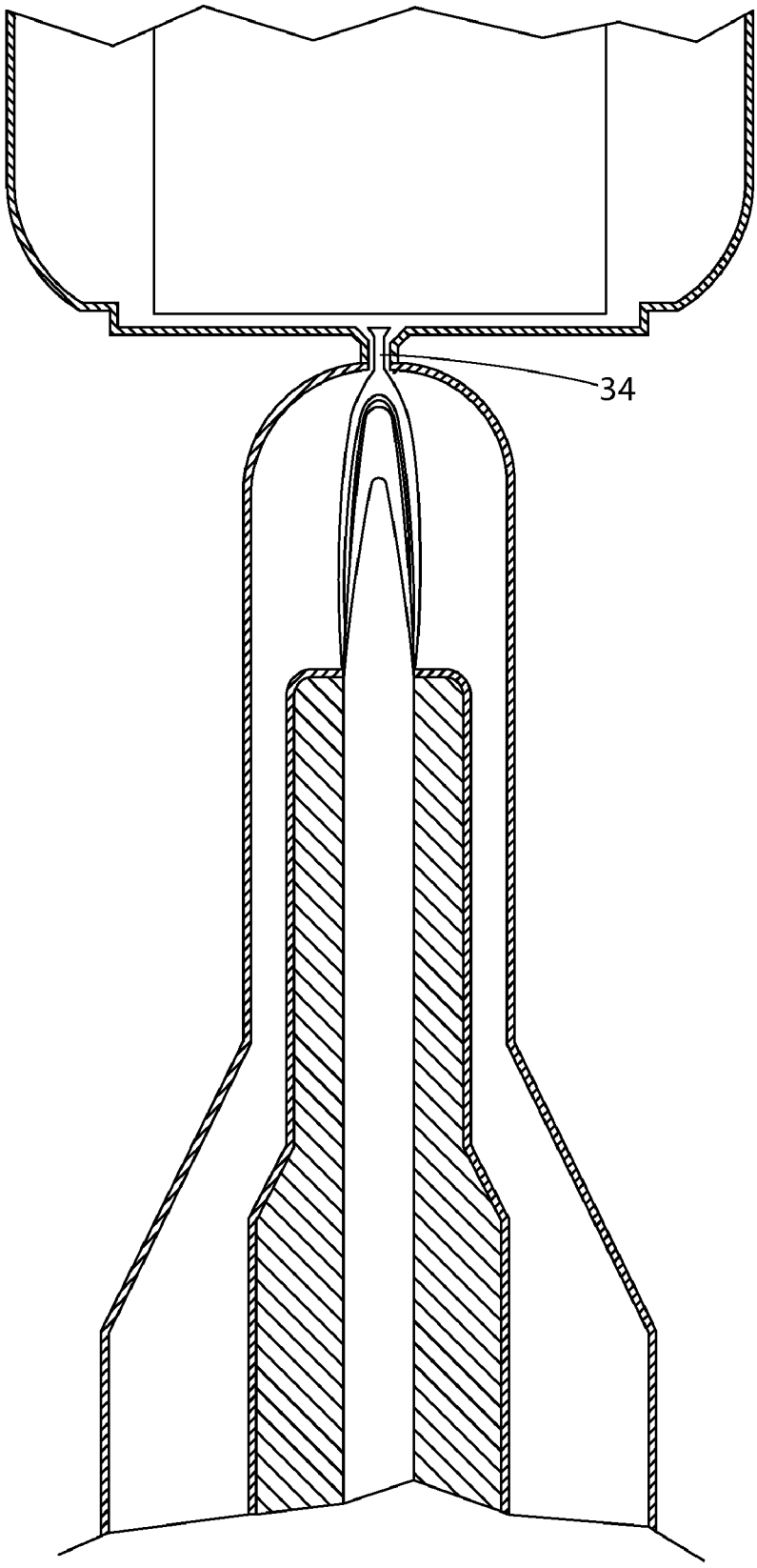
FIG. 4 is computational fluid dynamics model's numerical solution showing one possible example of the flow of liquid into the orifice of a relatively small scale version of the apparatus described herein.
Figure 5:
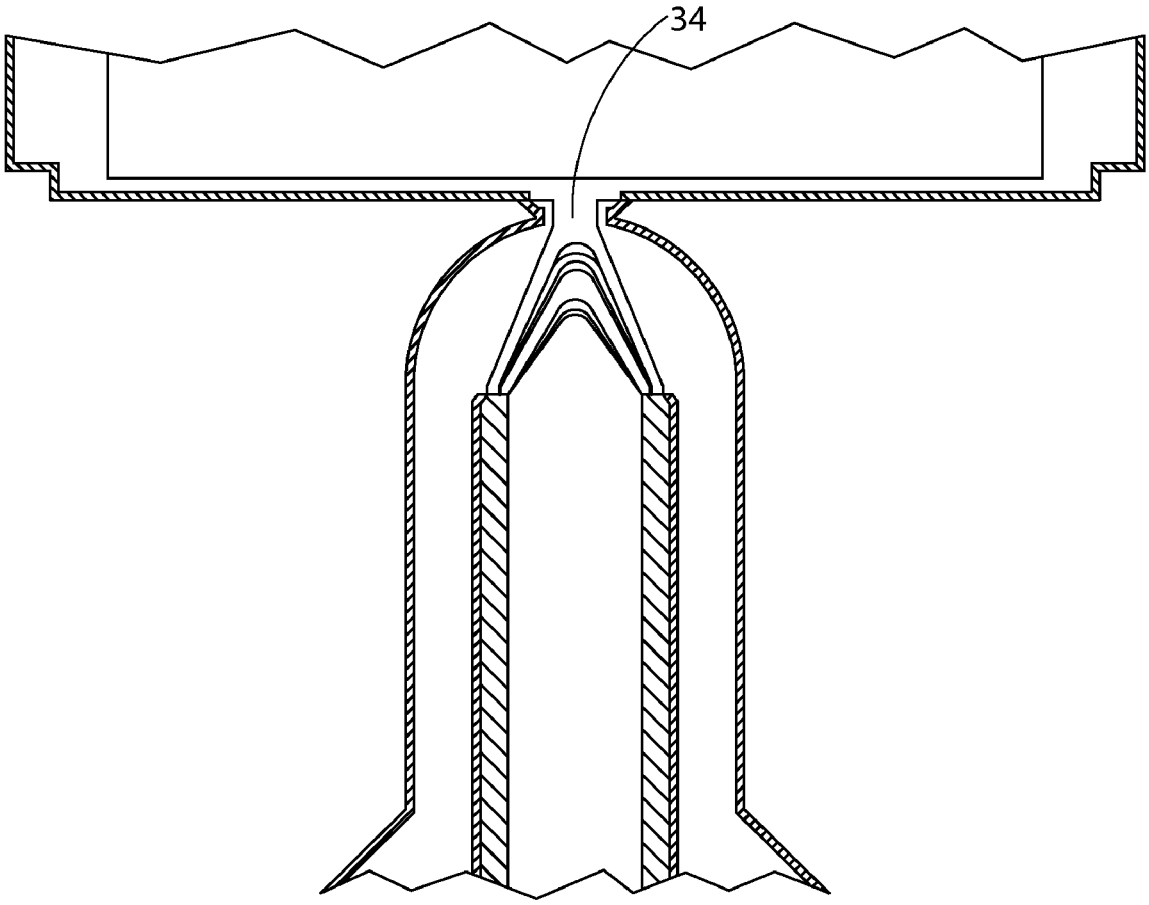
FIG. 5 is computational fluid dynamics model's numerical solution showing one possible example of the flow of liquid into the orifice of a larger scale version of the apparatus described herein.

FIGS. 4 and 5 show the liquid stream flowing into the orifice 34 is in a substantially axially symmetrical configuration in apparatuses of two different sizes/scales. FIG. 4 is computational fluid dynamics model's numerical solution showing one possible example of the flow of liquid into the orifice of a relatively small scale version of the apparatus described herein. FIG. 5 is computational fluid dynamics model's numerical solution showing one possible example of the flow of liquid into the orifice of a larger scale version of the apparatus described herein.

Figure 3:
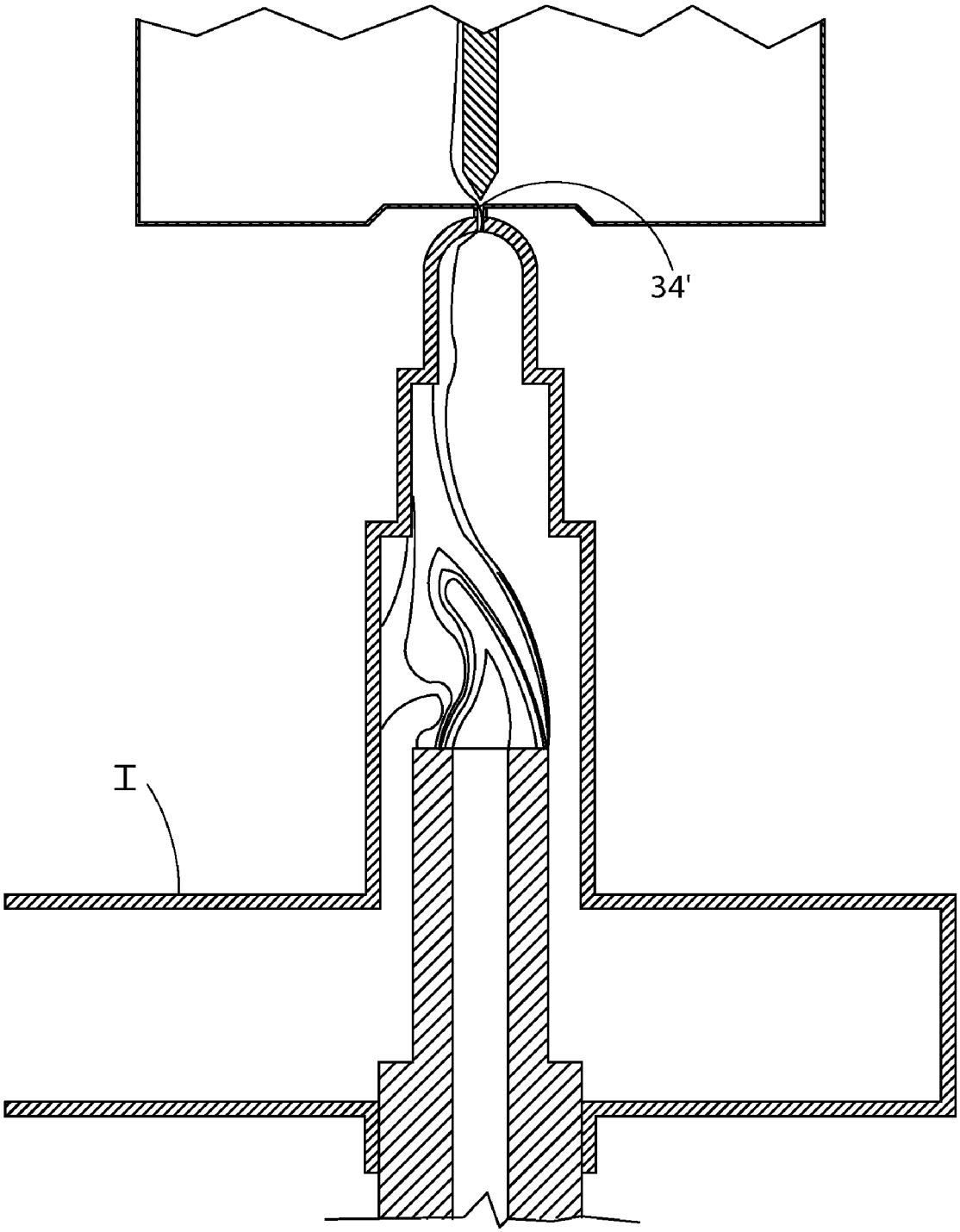
Fig. 3 Prior art
FIG. 3 is computational fluid dynamics model's numerical solution showing one possible example of the flow of liquid into the orifice of a prior art liquid whistle.

This can be contrasted with the prior art device shown in FIG. 3. In the prior art device, the diameter of the inlet, I, is equal to or larger than the diameter of the upstream mixing chamber. As a result, in this prior art device, the velocity of the liquid flowing into the upstream mixing chamber through the inlet I will be maintained (versus being slowed or "conditioned") when it enters the upstream mixing chamber. When this liquid stream enters the stream of liquid flowing in the upstream mixing chamber at a right angle, it will cause an abrupt change in the momentum of the stream of liquid flowing in the upstream mixing chamber. This will tend to deflect the liquid stream coming from the inlet I off the walls of the upstream mixing chamber and cause the combined liquid stream to change direction. Thus, as shown in FIG. 3, the stream of liquid flowing into the orifice 34' is not axially symmetrical. This prior art device suffers from the disadvantage that non-uniform mixtures are formed at various portions of the stream of liquid flowing into the orifice 34.

In some embodiments, it is desirable for the apparatus 20 described herein to be substantially free of liquid baffles or turning vanes in the path of liquid into the orifice 34 so that the apparatus 20 will be easier to clean. In alternative embodiments, baffles or turning vanes can be used to create axially symmetric flow; however, this would make cleaning the apparatus more difficult.

Zone 3 comprises a zone at the orifice 34. The element 32 with the orifice 34 therein can be in any suitable configuration. In some embodiments, the element 32 with the orifice 34 therein can comprise a single component. In other embodiments, the element 32 with the orifice 34 therein can comprise one or more components of an orifice component system. One non-limiting embodiment of an orifice component 32 system is shown in greater detail in FIGS. 6 and 7.

Figure 6:
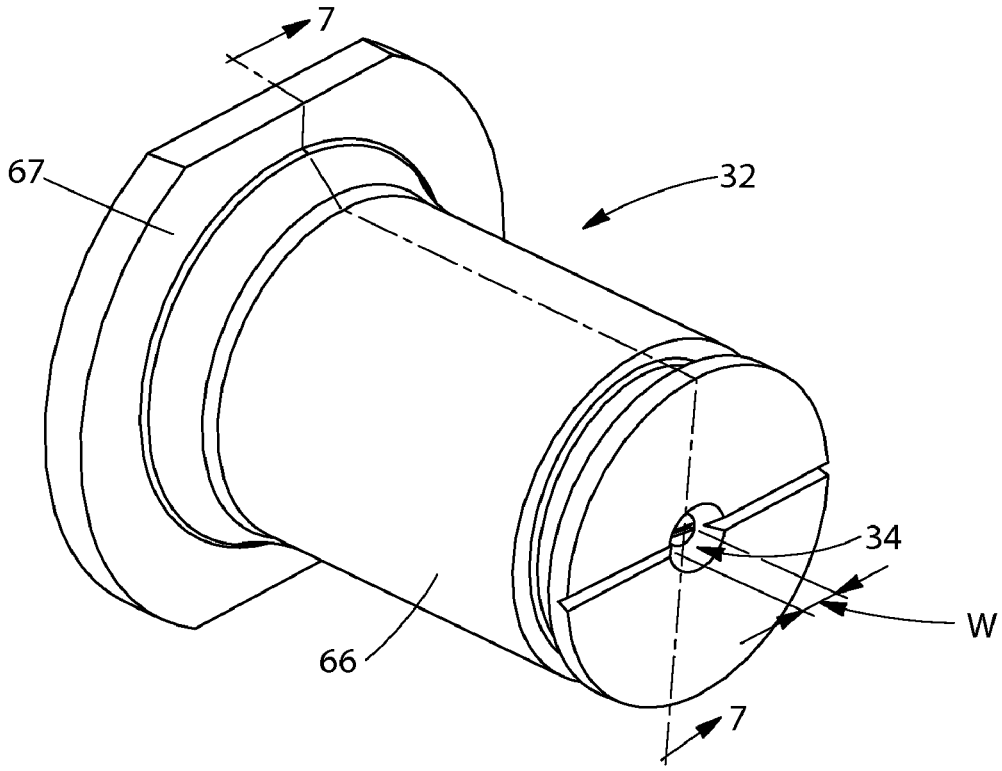
FIG. 6 is an enlarged perspective view of one embodiment of an orifice component for use in the apparatus shown in FIG. 1.
Figure 7:
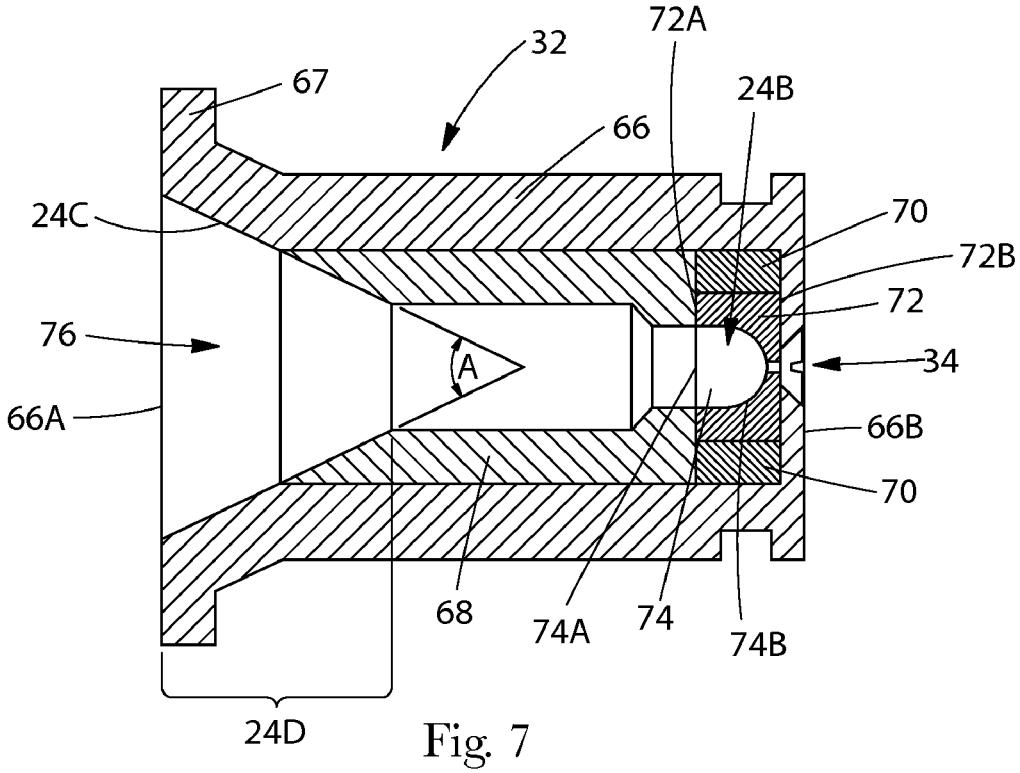
FIG. 7 is a cross-section of the element shown in FIG. 6 taken along line 7-7 of FIG. 6.

In the embodiment shown in FIGS. 6 and 7, the orifice component 32 system comprises an orifice component housing (or "orifice casing") 66, a nozzle backing 68, an orifice insert 70, and a nozzle 72. Looking at these components in greater detail, the orifice component housing 66 is a generally cylindrically-shaped component having side walls and an open upstream end 66A, and a substantially closed (with the exception of the opening for the orifice 34) downstream end 66B. The orifice component housing 66 comprises a flange 67 adjacent to its upstream end 66A. The nozzle backing 68 is sized and configured to fit inside the orifice component housing 66 adjacent to the nozzle 72 and orifice insert 70 to hold the nozzle and orifice insert 70 in place within the orifice component housing. The nozzle backing 68 has interior walls which define a passageway through the nozzle backing, an upstream end, and a downstream end. The orifice insert 70 comprises a cylindrical ring that fits inside the orifice component housing 66 adjacent to the downstream end 66B of the orifice component housing 66. The nozzle 72 comprises a separate component with generally cylindrical exterior walls, and a passageway 74 through the center of the same. The passageway 74 forms an enlarged opening 74A at the upstream end 72A of the nozzle 72 and has side walls that taper to form a rounded surface 74B as the downstream end 72B of the nozzle 72 is approached. The passageway 74 opens into the orifice 34 at the downstream end 74B thereof The components of the orifice component system 32 form a channel 76 defined by walls having a substantially continuous inner surface. As a result, the orifice component system 32 has few, if any, crevices between components and may be easier to clean than prior devices. Any joints between adjacent components can be highly machined by mechanical seam techniques, such as electro polishing or lapping such that liquids cannot enter the seams between such components even under high pressures.

In addition, as shown in FIGS. 6 and 7, the orifice component 32 may have an equivalent or greater length (as measured between the downstream end of the flange 67 (that is, where the flange 67 ends) to the downstream end 66B of the orifice component housing) than width (or diameter). In such an embodiment, the orifice component system 32 will provide relatively large contact surfaces on the exterior portions of the same for more precise alignment of the orifice component 32 in the apparatus (in comparison to prior devices that have flat, plate-like orifice components). Numerous other configurations for the components of the orifice component 32 system are also possible.

The orifice component 32 system, and the components thereof, can be made of any suitable material or materials. Suitable materials include, but are not limited to: stainless steel, tool steel, titanium, cemented tungsten carbide, diamond (e.g., bulk diamond) (natural and synthetic), and coatings of any of the above materials, including but not limited to diamond-coated materials. The insert 70 and/or the nozzle 72 may be made of a harder material than other portions or components of the structure comprising the orifice component system 32. The insert 70 and nozzle components are used so that the other larger portions or components of the orifice component system 32 can be made from less hard, and less expensive materials, or without using materials with a hard lining.

In the embodiment shown in FIGS. 6 and 7, it may be desirable for at least the nozzle 72 to be made of a material having a Vickers hardness of greater than or equal to about 20 GPa because this is the portion of the orifice component system 32 that is subject to the greatest forces when liquids and/or other material is sprayed through the orifice 34. A variety of materials having a Vickers hardness of greater than or equal to about 20 GPa are described in provisional U.S. Patent Application Ser. No. 60/937,501, filed Jun. 28, 2007.

The orifice component system 32, and the components thereof, can be formed in any suitable manner. Any of the components of the orifice component system 32 can be formed from solid pieces of the materials described above which are available in bulk form. The components may also be formed of a solid piece of one of the materials specified above, which is coated over at least a portion of its surface with one or more different materials specified above. As noted above, the components of the orifice component system 32 shown in the drawings are formed from more than one piece. In one version of the embodiment shown in the drawings, the nozzle 72 is made of synthetic bulk diamond. The orifice 34 is provided in the nozzle 72 by cutting using a laser or hot wire diamond cutter, or diamond-based cutting tools. The nozzle 72 is optionally polished using diamond dust. The orifice insert 70 is made of tungsten carbide. The rest of the orifice component system 32, including the housing 66 and nozzle backing 68 are made of stainless steel.

In other embodiments, the element 32 with the orifice 34 therein can comprise a single component having any suitable configuration, such as the configuration of the orifice component system shown in FIGS. 6 and 7. Such a single component could be made of any suitable material including, but not limited to, stainless steel. In other embodiments, two or more of the components of the orifice component system 32 described above could be formed as a single component. In still other embodiments, the functions provided by one or more of the components of the orifice component system 32 described above (such as the function provided by the tapered portion 24D) could be performed by a separate component that is not part of the orifice component system 32.

The orifice 34 is configured, either alone, or in combination with some other component, to mix the fluids and/or produce shear and/or cavitation in the fluid(s), or the mixture of the fluids. The orifice 34 can be in any suitable configuration. Suitable configurations include, but are not limited to: slot-shaped, eye-shaped, cat eye-shaped, elliptically-shaped, triangular, square, rectangular, in the shape of any other polygon, or circular. In some embodiments, it may be desirable for the width, W, of the orifice to exceed the height of the orifice. In such embodiments, the orifice 34 may spray liquid in a jet in the form of a flat ribbon of spray in the longitudinal direction. The width of the orifice 34 may be any multiple of the height of the orifice including, but not limited to: 1.1, 1.2, 1.3, 1.4, 1.5, 2, . . . , 2.5, 3, 3.5, . . . , etc. up to 100 or more times the height of the orifice. The orifice 34 can be of any suitable width including, but not limited to, up to about 1 inch (2.54 cm), or more. The orifice 34 can have any suitable height including, but not limited to, up to about 0.5 inch (about 1.3 cm), or more.

In some embodiments, the shape of the orifice 34 may be matched between different sizes of orifices and/or apparatuses to provide substantially the same distribution of materials (or "species") across the opening of the orifice 34 during operation of the apparatus 20. This can be done by maintaining substantially the same ratio of the perimeter of the orifice 34 to the area of the orifice 34. In certain embodiments, it is desirable for the mean and the standard deviation of the distribution of materials across the opening of the orifice 34 in two different size/scale apparatuses to be at least within 20% of each other. This will enable substantially the same transformations to be carried out on different sizes of orifices and/or apparatuses while maintaining the physical parameter (including, but not limited to the orifice perimeter and geometry) consistency necessary for scale-up.

In some cases, the apparatus 20 may comprise a blade 40. A blade 40 may be used, for example, if it is desired to use the apparatus 20 to form emulsions with a lower mean droplet size than if the blade was not present. As shown in FIG. 2, Zone 4 comprises a zone located in the region extending from where the liquid exits the orifice 34 to the leading edge 84 of the blade 40. Zone 5 comprises the boundary layer around the blade 40.

Figure 8:
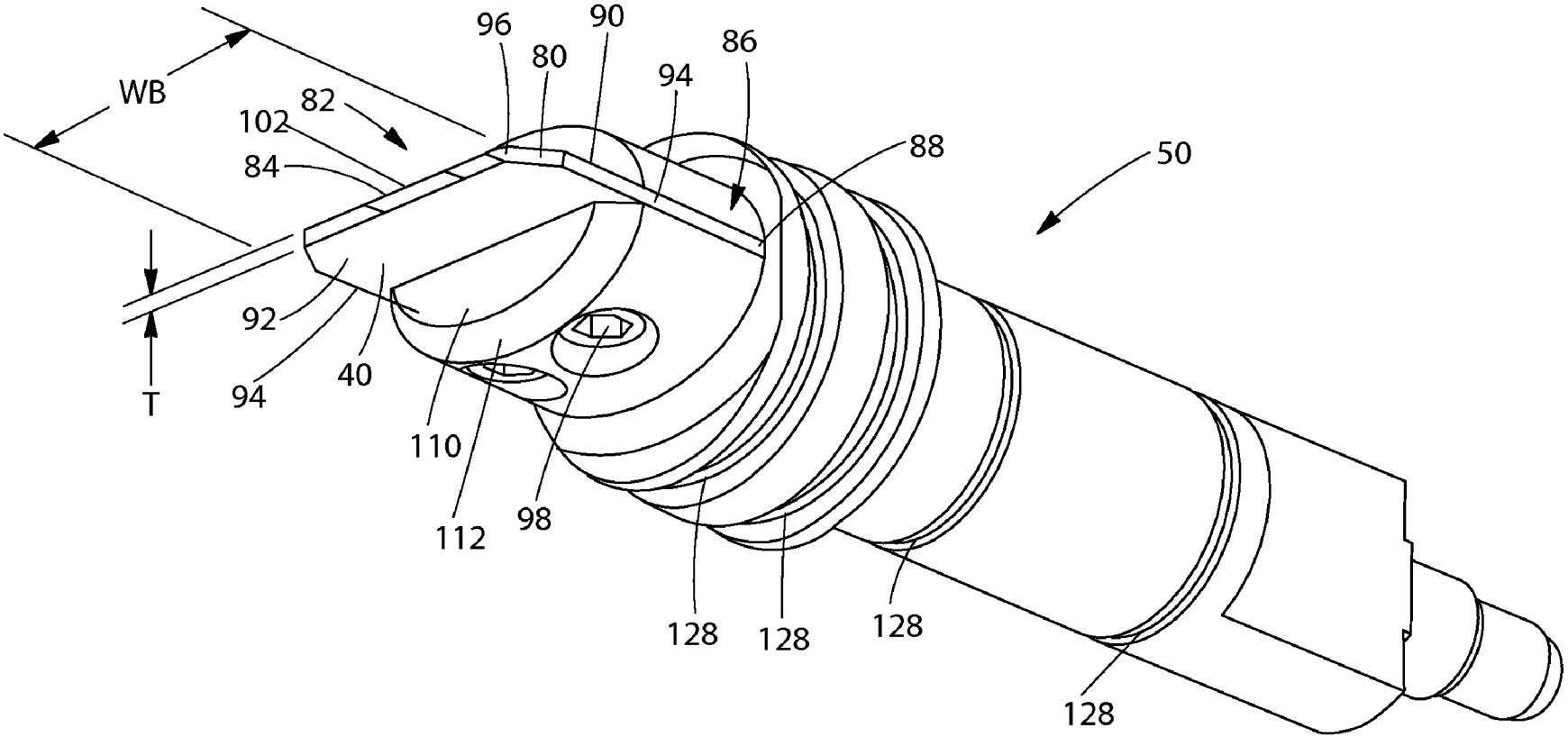
FIG. 8 is an enlarged perspective view of one embodiment of a blade holder and blade for use in the apparatus shown in FIG. 1.

As shown in FIG. 8, the blade 40 has a front portion 82 comprising a leading edge (or "tip") 84, and a rear portion 86 comprising a trailing edge 88. The blade 40 also has an upper surface 90, a lower surface 92, and a thickness, T, measured between the upper and lower surfaces. In addition, the blade 40 has a pair of side edges 94 and a width, WB, measured between the side edges.

The blade 40 can have any suitable configuration. As shown in FIG. 8, the blade 40 can comprise a tapered portion 96 in which the thickness, T, of the blade increases from the leading edge 84 in a direction from the leading edge 84 toward the trailing edge 88 along a portion of the distance between the leading edge and the trailing edge. The blade 40 shown in FIG. 8 has a single tapered or sharpened edge forming its leading edge 84. The leading edge 84 of the blade 40 may be sharpened, but in other embodiments, it need not be sharpened. It should be understood that in other embodiments, the blade 40 may have two, three, or four or more tapered or sharpened edges so that the blade 40 can be inserted into the apparatus 20 with any of the sharpened edges oriented to form the leading edge 84 of the blade 40. This will multiply the useful life of the blade before it is necessary to repair or replace the same. In addition, as shown in FIG. 8, the front corners 80 of the blade 40 can be cut off, or otherwise blunted or notched so that the angles formed by the different edges (e.g., edges 84 and 94) of the blade 40 at the corners are greater than 90°.

Figure 9A:
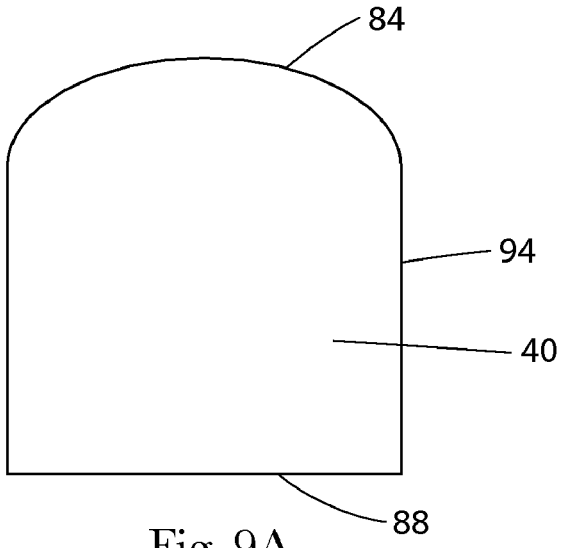
FIG. 9A is a plan view of an alternative embodiment of a blade having a different configuration.
Figure 9B:
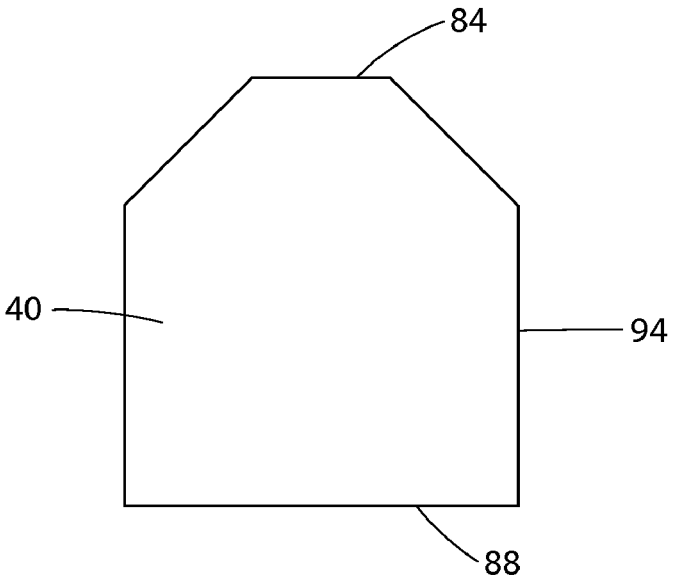
FIG. 9B is a plan view of an alternative embodiment of a blade having a different configuration.

FIGS. 9A and 9B show that the blade 40 can have numerous other configurations. As shown in FIGS. 9A and 9B, the leading edge 84 of the blade, when viewed from above, can be comprised of rectilinear segments, curvilinear segments, or combinations thereof. FIG. 9A shows an alternative embodiment of a blade 40 that comprises a convex curvilinear leading edge 84. FIG. 9B shows an alternative embodiment of a blade 40 that comprises a leading edge 84 comprising rectilinear segments.

The blade 40 can have any suitable dimensions. In certain embodiments, the blade 40 can range in size from as small as 1 mm long and 7 microns thick to as big as 50 cm long and over 100 mm thick. One non-limiting example of a small blade is about 5 mm long and 0.2 mm thick. A non-limiting example of a larger blade is 100 mm long and 100 mm thick.

As shown in FIG. 8, when the blade 40 is inserted into the apparatus 20, a portion of the rear portion 86 of the blade 40 is clamped, or otherwise joined inside the apparatus so that its position is fixed. The blade 40 can be configured in any suitable manner so that it can be joined to the inside of the apparatus. As shown in FIG. 8, in one non-limiting embodiment, the rear portion 86 of the blade has at least one hole 98 therein for receiving an element that passes through the hole 98. This hole 98 and element serves as at least part of the mechanism used to retain the blade 40 in place inside the apparatus. The blade 40 can also be joined to a holder 50 which may be comprised of metal or another suitable material. The remainder of the blade 40, including the front portion 82 of the blade 40 is free and is cantilevered relative to the fixed portion.

The blade 40 can comprise any suitable material or materials. The blade 40 desirably will comprise a material, or materials, that are chemically compatible with the fluids to be processed. (The same may also be desirable for the components of the orifice component system 32.) It may be desirable for the blade 40 to be comprised at least partially of a material that is chemically resistant to one or more of the following conditions: low pH's (pH's below about 5); high pH's (pH's above about 9); salts (chloride ions); and oxidation.

Suitable materials for the blade 40 include, but are not limited to any material or materials described herein as being suitable for use in the orifice component system 32, and the components thereof. It should be understood, however, that the materials specified herein do not necessarily have all of the desired chemical resistance properties.

The entire blade 40 may be comprised of one of the above materials, such as stainless steel or diamond. Alternatively, a portion of the blade 40 may comprise one of the materials described herein as being suitable for use in the orifice component system 32, and another portion (or portions) of the blade 40 may comprise a different one of these materials. For example, in some cases, it may be desirable for a portion of the blade 40, such as the tapered portion 96, to comprise a harder material (such as diamond) than the remainder of the blade 40. This may be desirable since the tapered portion 96 forms the leading edge 84 of the blade 40 and will be the portion of the blade subject to greatest wear during use. The remainder of the blade 40 (other than the leading edge of the blade) can be comprised of some other material, such as a material that has one or more of the following properties: is less hard, less expensive, more ductile, or less brittle than the tapered portion 96.

The blade 40, or various portions thereof, may have any suitable hardness. In one non-limiting embodiment, at least the tapered portion 96 of the blade is formed from a material with a Vickers hardness of greater than or equal to about 20 GPa. In such embodiments, the remainder of the blade 40 can comprise a material that has a Vickers hardness of less than 20 GPa. For instance, at least a portion of the tapered portion 96 of the blade 40 could comprise a diamond insert 102 (such as in the center of the leading edge 84 of the blade), and the remainder of the blade could be made of stainless steel. Such an insert could be joined to the remainder of the blade in any suitable manner, such as by bonding the insert to the remainder of the blade or by heat shrinking the insert onto the remainder of the blade. Alternatively, the tapered portion 96 of the blade 40 can be provided with a diamond coating, and the remainder of the blade could be made of stainless steel.

Several non-limiting examples of methods of forming a blade are possible. The blade 40 can comprise a bulk material, such as bulk diamond material. Such a material can be formed in any suitable manner such as by high pressure and high temperature sintering in the presence of bonding elements such as cobalt, nickel, or iron using presses that form synthetic diamond from diamond dust. In other embodiments, the blade 40 can be formed by forming a coated composite structure, or by coating layers of a material to form or build the final blade structure. The same techniques can be used to form components of the orifice component system 32.

In some embodiments, it is desirable to maintain substantially the same distance between the tip 84 of the blade 40 and the discharge of the orifice 34, and substantially the same pressure field distribution and turbulent energy dissipation in Zone 4 (the region where the liquid exits the orifice 34 to the leading edge 84 of the blade) and Zone 5 (the boundary layer around the blade) in at least two different sizes/scales of mixing devices (such as a pilot scale unit and a commercial scale unit). In some of these embodiments, it is desirable to maintain the same distance between the tip of the blade and the discharge of the orifice, and substantially the same pressure field distribution and turbulent energy dissipation in Zones 4 and 5 across all sizes/scales of mixing devices. This can improve the ability to scale-up between different sizes/scales of apparatuses.

In some embodiments, it may be desirable to change the configuration of the blade 40 (in Zone 5) so that the boundary layer configuration defined in terms of volume and volumetric shape factor of the liquid jet around the blades 40 used in different scales of the apparatus is substantially the same.

Figure 10:
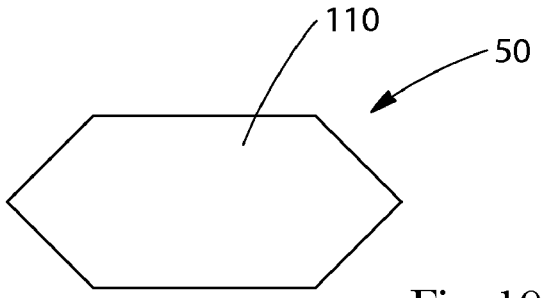
FIG. 10 is a front view of an alternative embodiment of the leading portion of a blade holder.

As shown in FIG. 8, in some embodiments, the apparatus 20 may comprise a blade holder 50 having at least a portion, such as the leading portion 110 thereof with a suitable axially symmetrical, radially asymmetrical cross-section. Suitable cross-sectional configurations include, but are not limited to rectangular, elliptical, flattened elliptical, race track-shaped (that is, a configuration with linear side edges and round ends), and polygonal having a long axis and short axis, which is symmetrical relative to both axes. One non-limiting example of a suitable polygonal cross-sectional shape is shown in FIG. 10. In the embodiment shown in FIG. 8, a portion of the blade holder has an elliptically-shaped cross-section. Providing the leading portion 110 of a blade holder 50 with such a configuration can ensure that a symmetrical flow of liquid is maintained over the blade 40 when the apparatus is in use. The leading portion 110 of the blade holder 50 may also have a small chamfer 112 around the perimeter of the same for improved recirculation in the downstream mixing chamber 26.

Zone 6 comprises the downstream mixing chamber 26. In some embodiments, it is desirable to maintain substantially the same flow pattern and residence time (that is, mass weighted residence time) and/or residence time distribution in Zone 6 in at least two different sizes/scales of apparatuses (such as a pilot scale unit and a commercial scale unit). In some of these embodiments, it is desirable to maintain the same flow pattern and mass weighted residence time in Zone 6 across all sizes/scales of apparatuses to improve the ability to scale-up between different sizes/scales of apparatuses. In some embodiments, it is also desirable to maintain substantially the same iso-volume percentage of volume at certain pressure ranges as a fraction of total flow volume in Zone 6 in at least two different sizes/scales of apparatuses.

The apparatus 20 comprises at least one outlet or discharge port 30 in Zone 7. In the embodiment shown in the drawings, the apparatus 20 comprises one outlet 30A and one combination outlet/drain 30B. In this embodiment, one of the discharge ports, outlet 30A, is aligned adjacent the upper surface 90 of the blade 40, and one of the discharge ports, combination outlet/drain 30B, is aligned with the lower surface 92 of the blade 40. The outlet 30A can also serve as an inlet for flushing the apparatus 20 during cleaning and, thus, may be referred to as a combination outlet/flushing inlet. The combination outlet/drain 30B is on the gravitational bottom of the apparatus 20. It may be desirable for the combination outlet/drain 30B to comprise at least an initial section that is oriented vertically downward (which orientation may be normal to the surfaces 90 and 92 of the blade 40, or may be described as being generally parallel to the height dimension of the orifice 34 if, for example, no blade is present). The location of the discharge ports 30A and 30B above and below the blade 40, respectively, will help to ensure that there is a symmetrical flow of liquid over the blade 40 during use.

Figure 12:
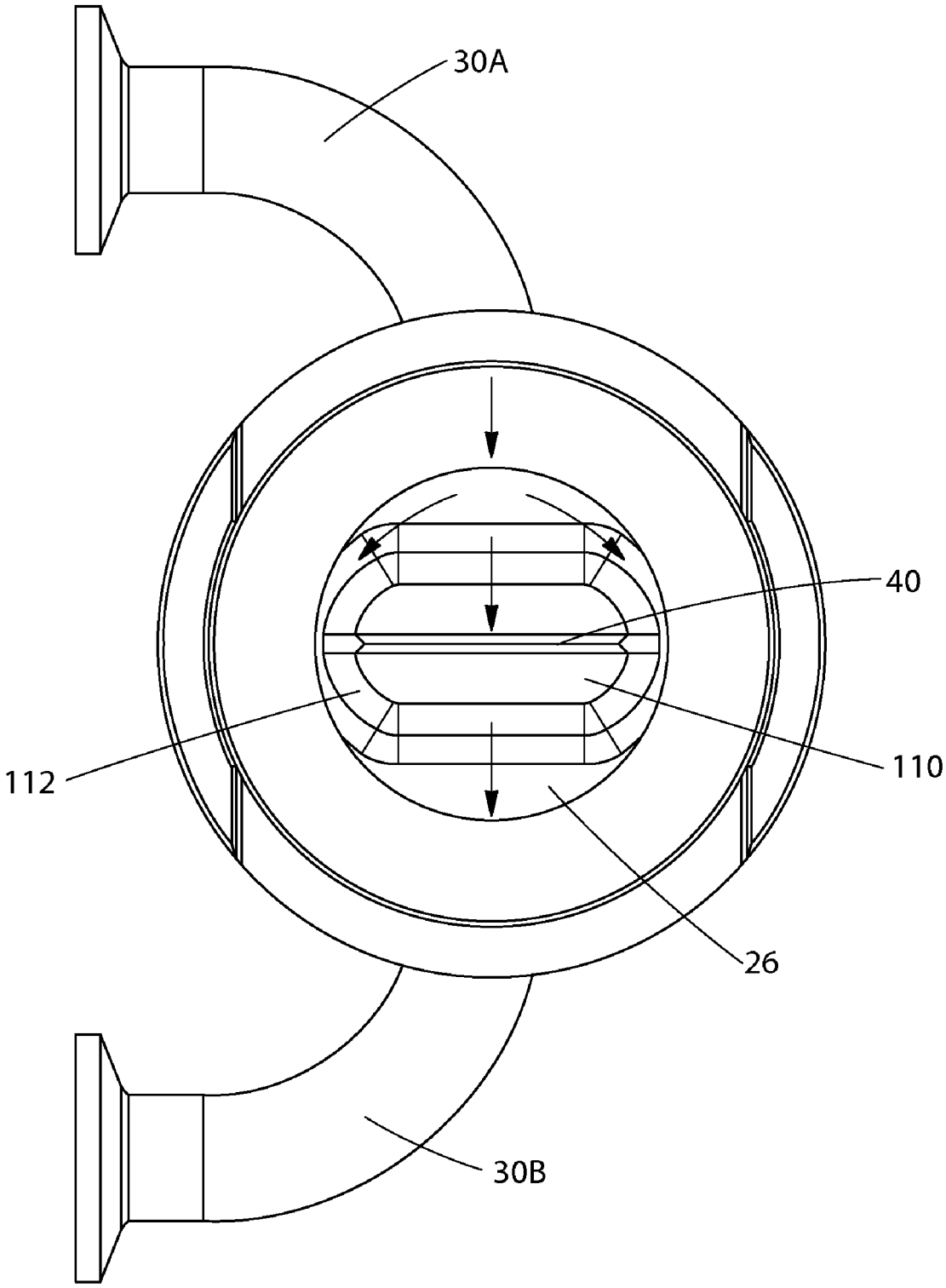
FIG. 12 is a cross-section of the apparatus taken along line 12-12 in FIG. 11.

In addition to providing an outlet for the mixed liquids from the apparatus 20 during use, water (or other cleaning liquid) can be flushed into the apparatus 20 through the discharge ports 30A and 30B to clean the apparatus 20 between uses. The configuration of the blade holder 50 described above provides a structure which is believed to better distribute liquid used to clean the apparatus 20 throughout the downstream mixing chamber 26 when the downstream mixing chamber 26 is flushed. FIG. 12 shows one non-limiting example of the flow of liquid around the leading portion 110 of the blade holder 50 during a flushing operation. The direction of the flow of cleaning liquids is shown by arrows. As shown in FIG. 12, it is desirable for the blade holder 50 to be sized and configured so that there is some space around the sides of the same for cleaning liquid to flow during a flushing operation. As shown in FIG. 12, the mixing chamber 26 has at least one width, and the width of the leading portion 110 of the blade holder 50 (measured parallel to the blade) is less than or equal to 90% of the width of the portion of the downstream mixing chamber 26 corresponding to the cross-section of the leading portion 110 of the blade holder 50. In other words, the blade holder 50 may be sized and configured so that there is at least about a 5% gap on each side of the blade holder 50 at the portion of the downstream mixing chamber 26 corresponding to the leading portion 110 of the blade holder 50.

It may also be desirable that the cross-section of the blade holder 50 be of a non-circular configuration such that the width of the blade holder 50 is greater than the height of the blade holder to aid in flushing the downstream mixing chamber 26. When the cross-section of the blade holder 50 is circular, the liquid used to clean the apparatus 20 will have a tendency to flow around the sides of the blade holder 50 without being distributed over the upper and lower surfaces of the blade 40. When the blade holder 50 has a non-circular cross-section with a larger space between the walls of the downstream mixing chamber 26 and the blade holder 50 at the top and bottom of the downstream mixing chamber 26 than there is between the blade holder 50 and the walls of the downstream mixing chamber 26 along the sides of the downstream mixing chamber, this will help force the cleaning liquid over the upper and lower surfaces of the blade 40.

It is also desirable that the interior of the apparatus 20 be substantially free of any crevices, nooks, and crannies so that the apparatus 20 will be more easily cleanable between uses. One prior art device, for example, has a metal backing block to hold the component with the orifice therein in place. The gaps in the metal-to-metal contact creates crevices therebetween into which liquid can enter and remain between uses of the apparatus. In addition, this prior art device has additional internal ports for the passage of liquid through the device during use of the device before liquid flows out of the exit ports. In one embodiment of the apparatus 20 described herein, the orifice component 32 comprises several subcomponents that are formed into an integral structure. This integral orifice component 32 structure fits as a unit into the upstream mixing chamber housing 46 and requires no backing block to retain the same in place, eliminating such crevices. In the embodiment of the apparatus 20 shown in the drawings, the outlets 30A and 30B are also positioned immediately off the downstream mixing chamber 26 and are in direct liquid communication with the downstream mixing chamber 26 so that liquid passes directly from the downstream mixing chamber 26 out of the apparatus via the outlets 30A and 30B. The outlets 30A and 30B are, thus, integral with the downstream mixing chamber 26 and are free of any additional internal ports for the passage of liquid before liquid flows out of the outlets 30A and 30B. It may also be desirable for clean-ability for the apparatus 20 to be free of any conduits that permit liquid to flow into such conduits, but which end at a termination point ("dead end" or "dead leg") which is non-drainable.

As shown in FIGS. 2 and 8, in some embodiments, the apparatus 20 may comprise an improved structure for more precisely aligning the blade 40 with the orifice 34, and/or for retaining the blade 40 in alignment with the orifice 34. This structure can be used to position (e.g., to center) the blade 40 relative to the liquid jet coming from the orifice 34, and reduce the tendency for the blade 40 to be displaced above or below the jet, or to have an angular tilt relative to the orifice 34. This may improve any tendency for the blade 40 to wear unevenly (e.g., top and bottom surfaces of the blade wearing differently) when the blade 40 and orifice 34 are not aligned properly, and/or one of these components is tilted relative to the other. In other embodiments, if desired, the structure could be used to orient the blade 40 in some other position relative to the orifice 34 (other than centered).

The blade holder 50 has one or more broad contact surfaces with the interior of the apparatus 20. In the embodiment shown in the drawings, the blade holder 50 having at least two broad cylindrical contact surfaces 120A and 120B with at least two sealing points 122 and 124 per surface disposed adjacent to the ends of each surface. In the embodiment shown in the drawings, the blade holder 50 has a larger dimension (e.g., diameter) at the upstream contact surfaces 120A than at the downstream contact surfaces 120B. It may be desirable for contact surfaces 120A and 120B to be machined surfaces, especially highly precisely machined surfaces. As shown in FIG. 8, the blade holder 50 comprises spaced apart recesses (circumferential grooves) 128 near the ends of each of the contact surfaces. The circumferential grooves may have O-rings 130 disposed therein. It may be desirable for the length of at least one of the contact surfaces 120A and 120B as measured between the centerline of the recesses therein for holding seals (e.g., O-rings 130) to be greater than or equal to width (e.g., the diameter) of the blade holder 50 at the location of the contact surface. In the embodiment shown in the drawings, this is the case for the downstream contact surface 120B. The length of the contact surfaces that is greater than the diameter of the blade holder 50 may be any multiple of the diameter of the blade holder, including, but not limited to: 1.1, 1.2, 1.3, 1.4, 1.5, 2, . . . , 2.5, 3, 3.5, . . . , etc. In addition, it may be desirable for all internal parts of the apparatus 20 that provide structural support or that have direct liquid contact with the parts to have O-ring seals.

Numerous other embodiments of the apparatus 20 and components therefor are possible as well. The blade holder 50 could be configured to hold more than one blade 40. For example, the blade holder 50 could be configured to hold two or more blades. In one version of such an embodiment, the blades could form an angle with each other. In another version of such an embodiment, the blades could intersect. If the blades intersect, they could intersect at any suitable angle. If they intersect at a 90° angle, they could be in the configuration of a cross when viewed from the front. Providing the apparatus with more than one blade could be done for any suitable purpose, including, but not limited to increasing the local turbulent dissipation rate.

A process for mixing by producing shear and/or cavitation in a fluid is also contemplated herein. In one non-limiting embodiment, the process utilizes an apparatus 20 such as that described above. The process comprises providing a mixing chamber, such as downstream mixing chamber 26, and an element, such as orifice component system 32, with an orifice 34 therein.

The process further comprises introducing at least one fluid into an optional upstream mixing chamber 24, and then into at least one entrance to the downstream mixing chamber 26 so that the fluid passes through the orifice 34 in the orifice component system 32. The at least one fluid can be supplied to the apparatus 20 in any suitable manner including, but not limited to through the use of pumps and motors powering the same. The pumps can supply at least one fluid to the apparatus under the desired pressure through inlets 22. The fluid(s), or the mixture of the fluids, pass through the orifice 34 under pressure. The orifice 34 is configured, either alone, or in combination with some other component, to mix the fluids and/or produce shear and/or cavitation in the fluid(s), or the mixture of the fluids.

The fluid can comprise any suitable liquid or gas. In some embodiments, it may be desirable for the fluid to comprise two or more different phases, or multiple phases. The different phases can comprise one or more liquid, gas, or solid phases. In the case of liquids, it is often desirable for the liquid to contain sufficient dissolved gas for cavitation. Suitable liquids include, but are not limited to: water, oil, solvents, liquefied gases, slurries, and melted materials that are ordinarily solids at room temperature. Melted solid materials include, but are not limited to waxes, organic materials, inorganic materials, polymers, fatty alcohols, and fatty acids. The fluid(s) can also have solid particles therein as described above.

The process may further comprise providing a blade, such as blade 40, disposed in the downstream mixing chamber 26 opposite the element 32 with an orifice 34 therein. In cases where a blade 40 is used, the process may include a step of forming the liquid into a jet stream and impinging the jet stream against the vibratable blade with sufficient force to induce the blade to vibrate harmonically at an intensity that is sufficient to generate cavitation in the fluid. The cavitation may be hydrodynamic or acoustic.

The process may be carried out under any suitable pressure. In certain embodiments, the pressure as measured at the feed to the orifice immediately prior to the point where the fluid passes through the orifice is greater than or equal to about 500 psi. (35 bar), or any number greater than 500 psi. including, but not limited to about: 1,000 (70 bar), 1,500 (100 bar), 2,000 (140 bar), 2,500 (175 bar), 3,000 (210 bar), 3,500 (245 bar), 4,000 (280 bar), 4,500 (315 bar), 5,000 (350 bar), 5,500 (385 bar), 6,000 (420 bar), 6,500 (455 bar), 7,000 (490 bar), 7,500 (525 bar), 8,000 (560 bar), 8,500 (595 bar), 9,000 (630 bar), 9,500 (665 bar), 10,000 psi. (700 bar), and any 500 psi. increment above 10,000 psi. (700 bar), including 15,000 (1,050 bar), 20,000 (1,400 bar), or higher.

A given volume of fluid can have any suitable residence time and/or residence time distribution within the mixing chamber 26. Some suitable residence times include, but are not limited to from about 1 microsecond to about 1 second, or more. The fluid(s) can flow at any suitable flow rate through the mixing chamber 26. Suitable flow rates range from about 1 to about 1,500 L/minute, or more, or any narrower range of flow rates falling within such range including, but not limited to from about 5 to about 1,000 L/min.

The process may also be run continuously for any suitable period of time. Suitable times include, but are not limited to greater than or equal to about: 30 minutes, 45 minutes, 1 hour, and any increment of 30 minutes above 1 hour.

The process may be used to make many different kinds of products including, but not limited to surfactants, emulsions, dispersions, and blends in the chemical, household care, personal care, pharmaceutical, and food and beverage industries.

Figure 11:
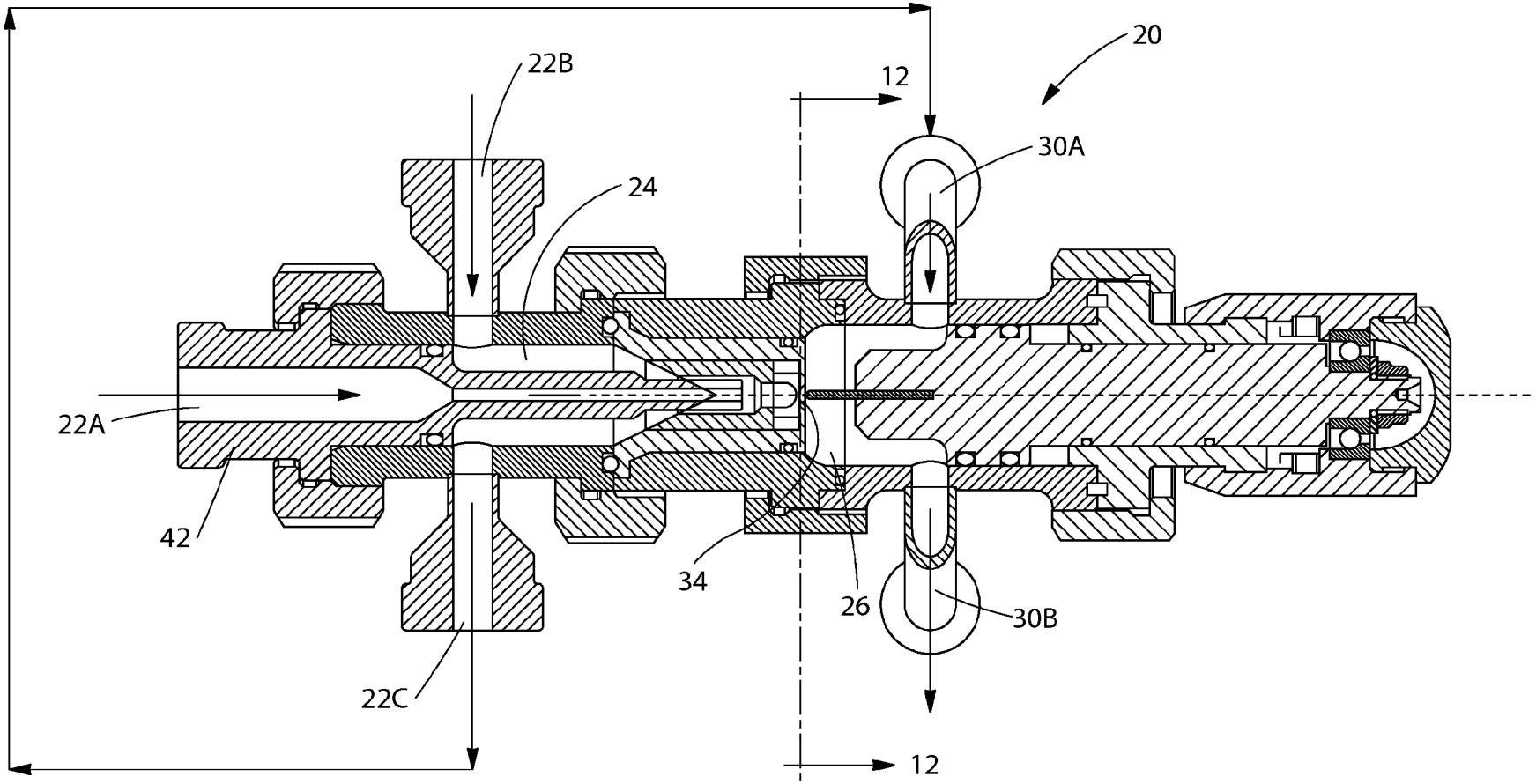
FIG. 11 is a schematic diagram that shows one version of a method for flushing the apparatus.

A process for cleaning the apparatus 20 is also provided herein. FIG. 11 is a schematic diagram that shows one version of a method for flushing the apparatus 20. As shown in FIG. 11, a cleaning liquid (for example, water, surfactant, etc.) can be fed into the apparatus 20 through the injector 42 and the inlet 22B. The streams of liquid introduced in this manner will mix in the upstream mixing chamber 24. Part of this mixed stream will pass through the orifice 34. If the second inlet 22C is also a drain, part of this mixed stream will also drain out the second inlet, combination inlet/drain, 22C. If desired, the combination inlet/drain 22C can be cross-connected to the upper outlet 30A, and the mixed stream that drains out the combination inlet/drain 22C can be channeled into the upper outlet 30A to flush the downstream mixing chamber 26. Flushing the downstream mixing chamber 26 can be carried out simultaneously with the flushing of the upstream mixing chamber 24, or it can be carried out either before, or after the flushing of the upstream mixing chamber 24 (sequentially). The cleaning liquid used to flush the downstream mixing chamber 26 can exit the downstream mixing chamber 26 through the lower outlet/drain 30B. This provides the advantage that the apparatus 20 is not limited to being cleaned by attempting to flush the entire apparatus 20 with cleaning liquid through the orifice 34. In other embodiments of such a process, the apparatus 20 could be flushed in other manners, such as in the reverse manner of the direction shown in FIG. 11. For instance, the cleaning liquid could be introduced in through the lower outlet/drain 30B, and then circulated in the reverse direction of the arrows shown in FIG. 11. At the end of such a process, the combination inlet/drain 22C and lower outlet/drain 30B could be opened to drain the apparatus 20.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An apparatus for mixing liquids by producing shear and/or cavitation, said apparatus comprising:

at least one inlet;

a mixing chamber, said mixing chamber comprising an entrance, said mixing chamber being in liquid communication with said at least one inlet;

an element with an orifice therein, said element being located adjacent the entrance of said mixing chamber, wherein said orifice is configured to spray liquid in a jet in a general direction and produce shear or cavitation in the liquid, wherein said orifice has a width and a height;

a substantially flat blade in said mixing chamber disposed opposite the element with an orifice therein, said blade having two opposing surfaces that are oriented substantially parallel to the general direction of said liquid spray, a leading edge, a trailing edge, and a tip on said leading edge, which tip is the portion of the blade positioned closest to the orifice; and at least one outlet in liquid communication with said mixing chamber for discharge of liquid following the production of shear or cavitation in said liquid, said at least one outlet being located downstream of said mixing chamber, wherein said apparatus has at least one of the following features:

(1) said at least one outlet is on the gravitational bottom of said apparatus and can also be used for draining said mixing chamber; and (2) said apparatus further comprises at least one drain on the gravitational bottom of said apparatus for draining said mixing chamber.

2. The apparatus of claim 1 wherein said at least one drain comprises at least an initial section that is oriented generally normal to the surfaces of said blade.

3. The apparatus of claim 1 having an interior, wherein the interior of said apparatus is substantially free of any crevices to minimize the accumulation of matter in the interior of the apparatus as liquid flows through the apparatus.

4. The apparatus of claim 1 wherein said at least one inlet comprises a first inlet that is axially oriented, said first inlet having an open downstream end out of which a liquid may be discharged, said apparatus further comprising a channel portion having an upstream end, a downstream end, and interior walls that define a liquid passageway therethrough, wherein the interior walls of said channel portion are tapered so that the interior walls are spaced farther apart at the upstream end thereof, and then become closer together as the downstream ends of said channel portion are approached, and the tapered portion of said channel portion occurs upstream of the open downstream end of the first inlet.

5. An apparatus for mixing liquids by producing shear and/or cavitation, said apparatus comprising:

at least one inlet;

a mixing chamber, said mixing chamber comprising an entrance, said mixing chamber being in liquid communication with said at least one inlet;

an element with an orifice therein, said element being located adjacent the entrance of said mixing chamber, wherein said orifice is configured to spray liquid in a jet and produce shear or cavitation in the liquid, wherein said orifice has a width and a height;

a blade in said mixing chamber disposed opposite the element with an orifice therein, said blade having two opposing surfaces, a leading edge, a trailing edge, and a tip on said leading edge, which tip is the portion of the blade positioned closest to the orifice;

a blade holder for holding said blade within said apparatus, wherein said blade holder is movable relative to said orifice so that the distance between the tip of said blade and said orifice can be varied; and at least one outlet in liquid communication with said mixing chamber for discharge of liquid following the production of shear or cavitation in said liquid, said at least one outlet being located downstream of said mixing chamber, wherein said apparatus has at least one of the following features:

(1) said at least one outlet is on the gravitational bottom of said apparatus and can also be used draining said mixing chamber; and (2) said apparatus further comprises at least one drain on the gravitational bottom of said apparatus for draining said mixing chamber.

6. An apparatus for mixing liquids by producing shear and/or cavitation, said apparatus comprising:

at least one inlet;

a mixing chamber, said mixing chamber comprising an entrance, said mixing chamber being in liquid communication with said at least one inlet;

an element with an orifice therein, said element being located adjacent the entrance of said mixing chamber, wherein said orifice is configured to spray liquid in a jet and produce shear or cavitation in the liquid, wherein said orifice has a width and a height;

a blade in said mixing chamber disposed opposite the element with an orifice therein, said blade having two opposing surfaces, a leading edge, a trailing edge, and a tip on said leading edge, which tip is the portion of the blade positioned closest to the orifice;

at least two outlets in liquid communication with said mixing chamber for discharge of liquid following the production of shear or cavitation in said liquid, wherein at least one outlet comprising a first outlet located downstream of said mixing chamber; and a second outlet comprising at least an initial section that is oriented generally normal to the surfaces of said blade and is disposed vertically above said blade when said apparatus is oriented so that said blade is horizontal, wherein said apparatus has at least one of the following features:

(1) said first outlet is on the gravitational bottom of said apparatus and can also be used for draining said mixing chamber; and (2) said apparatus further comprises at least one drain on the gravitational bottom of said apparatus for draining said mixing chamber wherein said at least one drain comprises at least an initial section that is oriented generally normal to the surfaces of said blade.

7. An apparatus for mixing liquids by producing shear and/or cavitation, said apparatus comprising:

at least one inlet;

a mixing chamber, said mixing chamber comprising an entrance, said mixing chamber being in liquid communication with said at least one inlet;

an element with an orifice therein, said element being located adjacent the entrance of said mixing chamber, wherein said orifice is configured to spray liquid in a jet and produce shear or cavitation in the liquid, wherein said orifice has a width and a height; and at least one outlet in liquid communication with said mixing chamber for discharge of liquid following the production of shear or cavitation in said liquid, said at least one outlet being located downstream of said mixing chamber, wherein said apparatus has at least one of the following features:

(1) said at least one outlet is on the gravitational bottom of said apparatus and can also be used for draining said mixing chamber;

(2) said apparatus further comprises at least one drain on the gravitational bottom of said apparatus for draining said mixing chamber; and (3) an upstream mixing chamber located between said at least one inlet and said orifice, a second drain on the gravitational bottom of said apparatus in liquid communication with said upstream mixing chamber, and a combination outlet/flushing inlet in liquid communication with said downstream mixing chamber, wherein said second drain is connectable to said combination outlet/flushing inlet.

8. The apparatus of claim 7 wherein:

said at least one inlet comprises a first inlet that is axially oriented, and said first inlet leads into said upstream mixing chamber;

said apparatus further comprises:

a second inlet leading into said upstream mixing chamber, said second inlet being radially oriented; and wherein said second drain comprises a combination inlet/drain.

9. The apparatus of claim 8 wherein said at least one outlet and said combination outlet/flushing inlet are positioned immediately off the mixing chamber and are in direct liquid communication with the mixing chamber so that liquid passes directly from the mixing chamber out of the apparatus through the outlet and combination outlet/flushing inlet.

10. An apparatus for mixing liquids by producing shear and/or cavitation, said apparatus comprising:

at least one inlet;

a mixing chamber, said mixing chamber comprising an entrance, said mixing chamber being in liquid communication with said at least one inlet;

an element with an orifice therein, said element being located adjacent the entrance of said mixing chamber, wherein said orifice is configured to spray liquid in a jet and produce shear or cavitation in the liquid, wherein said orifice has a width and a height;

a blade in said mixing chamber disposed opposite the element with an orifice therein, said blade having two opposing surfaces, a leading edge, a trailing edge, and a tip on said leading edge, which tip is the portion of the blade positioned closest to the orifice;

a blade holder, wherein said blade holder has a leading portion, said leading portion being the portion of said blade holder positioned closer to the orifice than other portions of said blade holder, wherein there is at least one cross-section through the leading portion of said blade holder, and said leading portion of said blade holder at said least one cross-section has a height and a width, wherein the width of said leading portion of said blade holder at said cross-section is greater than the height at said cross-section; and at least one outlet in liquid communication with said mixing chamber for discharge of liquid following the production of shear or cavitation in said liquid, said at least one outlet being located downstream of said mixing chamber, wherein said apparatus has at least one of the following features:

(1) said at least one outlet is on the gravitational bottom of said apparatus and can also be used for draining said mixing chamber; and (2) said apparatus further comprises at least one drain on the gravitational bottom of said apparatus for draining said mixing chamber.

11. The apparatus of claim 10 wherein said at least one cross-section of said leading portion of said blade holder is symmetrical about its horizontal and vertical axes.

12. The apparatus of claim 11 wherein said at least one cross-section is selected from the group consisting of: rectangular, elliptical, flattened elliptical, race track-shaped, and polygonal having a long axis and short axis.

13. The apparatus of claim 10 wherein a cross-section can be taken through said mixing chamber and the leading portion of said blade holder, and the mixing chamber and the leading portion of said blade holder each have a width, and the width of the leading portion of the blade holder is less than or equal to 90% of the width of the portion of the mixing chamber corresponding to the cross-section of the blade holder.

14. An apparatus for mixing liquids by producing shear and/or cavitation, said apparatus comprising:

at least one inlet;

a mixing chamber, said mixing chamber comprising an entrance, said mixing chamber being in liquid communication with said at least one inlet;

an element with an orifice therein, said element being located adjacent the entrance of said mixing chamber, wherein said orifice is configured to spray liquid in a jet and produce shear or cavitation in the liquid, wherein said orifice has a width and a height;

a blade in said mixing chamber disposed opposite the element with an orifice therein, said blade having two opposing surfaces, a leading edge, a trailing edge, and a tip on said leading edge, which tip is the portion of the blade positioned closest to the orifice;

a blade holder for holding said blade within said apparatus, wherein said blade holder is movable relative to said orifice so that the distance between the tip of said blade and said orifice can be varied; and at least one outlet in liquid communication with said mixing chamber for discharge of liquid following the production of shear or cavitation in said liquid, said at least one outlet being located downstream of said mixing chamber, wherein said apparatus has at least one of the following features:

(1) said at least one outlet is on the gravitational bottom of said apparatus and can also be used for draining said mixing chamber;

(2) said apparatus further comprises at least one drain on the gravitational bottom of said apparatus for draining said mixing chamber wherein said blade has at least one notch in its leading edge.

* * * * *